United States Patent [19]

Demmel

[11] 4,212,728

[45] Jul. 15, 1980

[54] CATALYTIC CRACKING OF HYDROCARBONS

[75] Inventor: Edward J. Demmel, Pitman, N.J.

[73] Assignee: Mobil Oil Corporation, New York, N.Y.

[21] Appl. No.: 887,575

[22] Filed: Mar. 17, 1978

Related U.S. Application Data

[63] Continuation-in-part of Ser. No. 683,115, May 4, 1976, abandoned.

[51] Int. Cl.[2] ..... C10G 11/04; C01B 29/12; B01J 8/24

[52] U.S. Cl. ..... 208/121; 208/113; 208/164; 252/417

[58] Field of Search ..... 208/113, 120, 121–124, 208/159, 164; 252/416–419

[56] References Cited

U.S. PATENT DOCUMENTS

| | | | |
|---|---|---|---|
| 4,064,037 | 12/1977 | Graven et al. | 208/120 |
| 4,072,600 | 2/1978 | Schwartz | 208/120 |
| 4,088,568 | 5/1978 | Schwartz | 208/120 |
| 4,093,535 | 6/1978 | Schwartz | 208/120 |
| 4,108,795 | 8/1978 | Hemler et al. | 252/419 |
| 4,115,250 | 9/1978 | Flanders et al. | 208/120 |

FOREIGN PATENT DOCUMENTS

| | | | |
|---|---|---|---|
| 2507343 | 2/1975 | Fed. Rep. of Germany | 208/120 |
| 46-25369 | 7/1971 | Japan | 208/120 X |
| 1146530 | 3/1965 | United Kingdom | 208/120 X |
| 2444911 | 5/1975 | United Kingdom | 208/120 |
| 1499682 | 2/1978 | United Kingdom | 208/120 |

*Primary Examiner*—Delbert E. Gantz
*Assistant Examiner*—G. E. Schmitkons
*Attorney, Agent, or Firm*—Charles A. Huggett; Vincent J. Frilette

[57] ABSTRACT

The combustion of carbon monoxide in the regenerator of a fluid catalytic cracking plant is controlled by adding a minute amount of a platinum metal compound or a rhenium compound to the circulating inventory of cracking catalyst during operation of the plant. The addition is accomplished by introducing a solution of the compound into a side-stream of the circulating inventory cooled preferably to about the boiling point of the solvent. Excess solvent may be used as coolant. The addition may be made to coked or to regenerated catalyst. Suitable solvents include water and organic fluids boiling above about 140° F. to about 600° F. A particularly suitable side-stream apparatus is disclosed.

10 Claims, 5 Drawing Figures

Figure 1
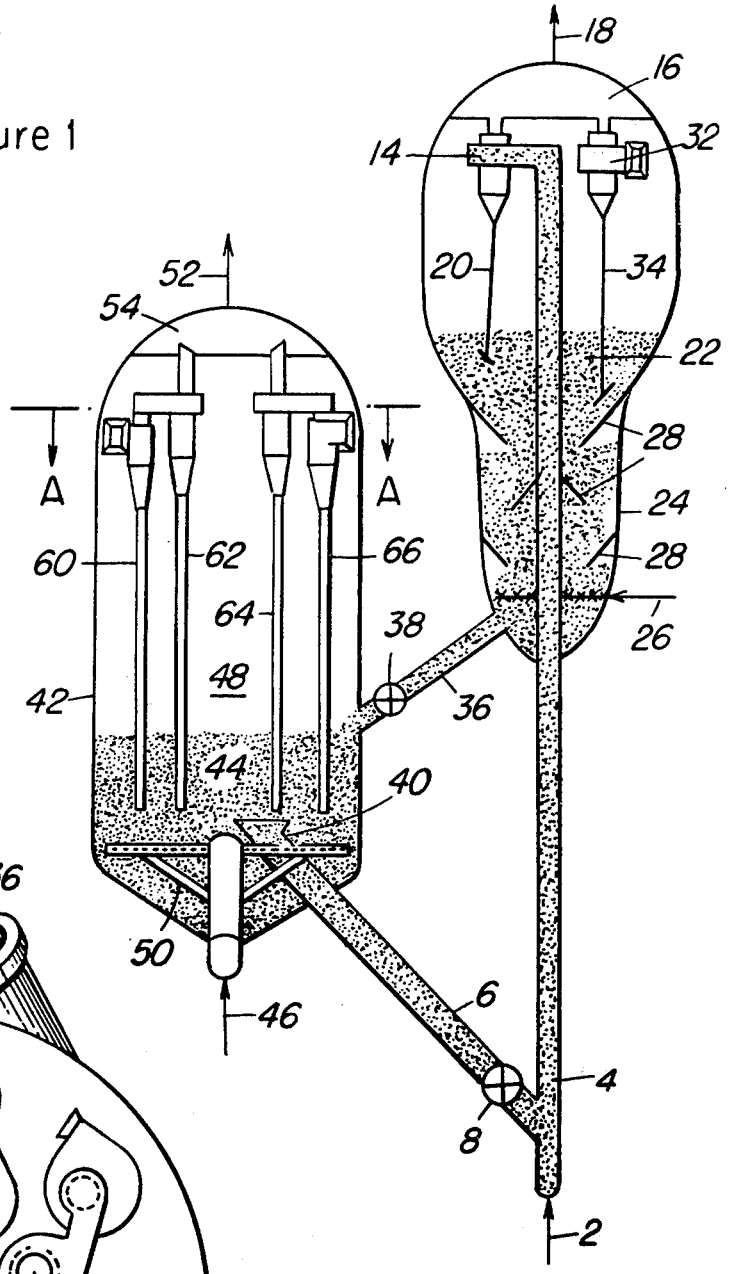
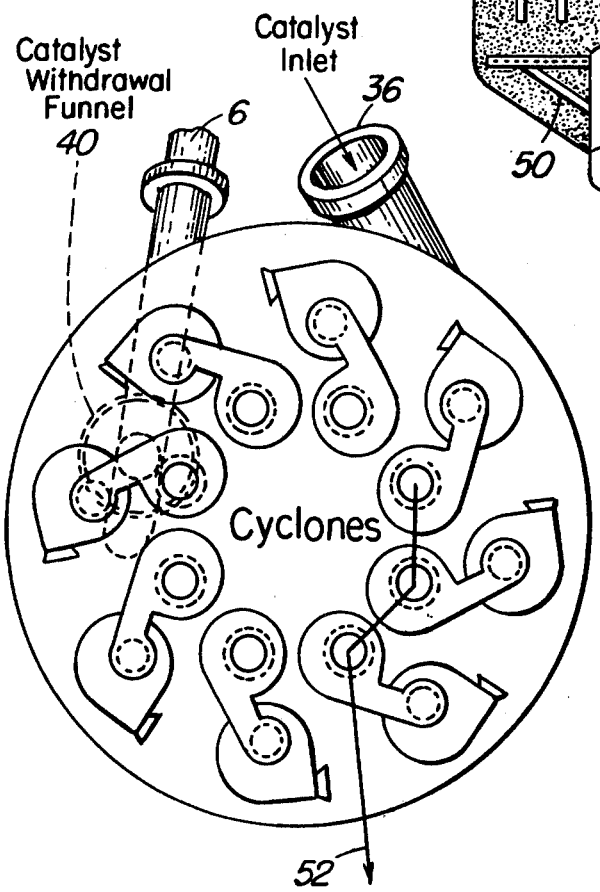
Figure 2

CATALYTIC CRACKING OF HYDROCARBONS

CROSS REFERENCE TO RELATED APPLICATIONS

This application is a continuation-in-part of U.S. Pat. application Ser. No. 683,115 filed May 4, 1976, and now abandoned.

BACKGROUND OF THE INVENTION

Field of the Invention

This invention is concerned with the catalytic cracking of hydrocarbons in the absence of added hydrogen. It particularly refers to an improved method for controlling the combustion of carbon monoxide in the regenerator of a fluid catalytic cracking apparatus by the addition of minute amounts of platinum, e.g., to the cracking catalyst. It further relates to a system wherein a side-stream of cracking catalyst is contacted with a metal compound, thereby controlling the combustion of carbon monoxide in the regenerator of the catalytic cracking apparatus.

BACKGROUND OF THE INVENTION

Fluid catalytic cracking of hydrocarbon oils is a major refinery process. The installed plants are usually designed to process from about 5,000 to 135,000 bbls/day of fresh feed. Most of the plants are quite large, and are capable of handling at least 40,000 bbls/day. The catalyst section of the plant consists of a cracking section where a heavy hydrocarbon feed is cracked in contact with fluidized cracking catalyst and a regenerator section where fluidized catalyst coked in the cracking operation is regenerated by burning with air. All of the plants utilize a large circulating inventory of cracking catalyst which is continuously circulating between the cracking and regenerator sections. The size of this circulating inventory in most existing plants is within the range of 50 to 600 tons.

Although the design and construction of individual plants vary, the essential elements, particularly the flow of catalyst, is illustrated by FIGS. 1 and 2 which show a conventional catalyst section of a fluid catalytic cracking plant.

FIG. 1 and the sectional element thereof shown in FIG. 2 are representative of the catalyst section of a commercial fluid catalytic cracking unit. Referring now to FIG. 1, a hydrocarbon feed 2 such as a gas oil boiling from about 600° F. up to 1000° F. is passed after preheating thereof to the bottom portion of riser 4 for admixture with hot regenerated catalyst introduced by standpipe 6 provided with flow control valve 8. A suspension of catalyst in hydrocarbon vapors at a temperature of at least about 950° F. but more usually at least 1000° F. is thus formed in the lower portion of riser 4 for flow upwardly therethrough under hydrocarbon conversion conditions. The suspension initially formed in the riser may be retained during flow through the riser for a hydrocarbon residence time in the range of 1 to 10 seconds.

The hydrocarbon vapor-catalyst suspension formed in the riser reactor is passed upwardly through riser 4 under hydrocarbon conversion conditions of at least 900° F. and more usually at least 1000° F. before discharge into one or more cyclonic separation zones about the riser discharge, represented by cyclone separator 14. There may be a plurality of such cyclone separator combinations comprising first and second cyclonic separation means attached to or spaced apart from the riser discharge for separating catalyst particles from hydrocarbon vapors. Separated hydrocarbon vapors are passed from separator 14 to a plenum chamber 16 for withdrawal therefrom by conduit 18. These hydrocarbon vapors together with gasiform material separated by stripping gas as defined below are passed by conduit 18 to fractionation equipment not shown. Catalyst separated from hydrocarbon vapors in the cyclonic separation means is passed by diplegs represented by dipleg 20 to a dense fluid bed of separated catalyst 22 retained about an upper portion of riser conversion zone 4. Catalyst bed 22 is maintained as a downwardly moving fluid bed of catalyst counter-current to rising gasiform material. The catalyst passes downwardly through a stripping zone 24 immediately therebelow and counter-current to rising stripping gas introduced to a lower portion thereof by conduit 26. Baffles 28 are provided in the stripping zone to improve the stripping operation.

The catalyst is maintained in stripping zone 24 for a period of time sufficient to effect a high temperature desorption of feed deposited compounds which are then carried overhead by the stripping gas. The stripping gas with desorbed hydrocarbons pass through one or more cyclonic separating means 32 wherein entrained catalyst fines are separated and returned to the catalyst bed 22 by dipleg 34. The hydrocarbon conversion zone comprising riser 4 may terminate in an upper enlarged portion of the catalyst collecting vessel with the commonly known bird cage discharge device or an open end "T" connection may be fastened to the riser discharge which is not directly connected to the cyclonic catalyst separation means. The cyclonic separation means may be spaced apart from the riser discharge so that an initial catalyst separation is effected by a change in velocity and direction of the discharged suspension so that vapors less encumbered with catalyst fines may then pass through one or more cyclonic separation means before passing to a product separation step. In any of these arrangements, gasiform materials comprising stripping gas hydrocarbon vapors and desorbed sulfur compounds are passed from the cyclonic separation means represented by separator 32 to a plenum chamber 16 for removal with hydrocarbon products of the cracking operation by conduit 18. Gasiform material comprising hydrocarbon vapors is passed by conduit 18 to a product fractionation step not shown. Hot stripped catalyst at an elevated temperature is withdrawn from a lower portion of the stripping zone by conduit 36 for transfer to a fluid bed of catalyst being regenerated in a catalyst regeneration zone. Flow control valve 38 is provided in coked catalyst conduit 36.

This type of catalyst regeneration operation is referred to as a swirl type of catalyst regeneration due to the fact that the catalyst bed tends to rotate or circumferentially circulate about the vessel's verticle axis and this motion is promoted by the tangential spent catalyst inlet to the circulating catalyst bed. Thus, the tangentially introduced catalyst at an elevated temperature is further mixed with hot regenerated catalyst or catalyst undergoing regeneration at an elevated temperature and is caused to move in a circular or swirl pattern about the regenerator's verticle axis as it also moves generally downward to a catalyst withdrawal funnel 40 (sometimes called the "bathtub") adjacent the regeneration gas distributor grid. In this catalyst regeneration environment, it has been found that the regeneration gases comprising flue gas products of carbonaceous material combustion tend to move generally vertically upwardly through the generally horizontally moving circulating catalyst to cyclone separators positioned above the bed of catalyst in any given vertical segment. As shown by FIG. 2, the catalyst tangentially introduced to the regenerator by conduit 36 causes the catalyst to circulate in a clockwise direction in this specific embodiment. As the bed of catalyst continues its circular motion some catalyst particles move from an upper portion of the mass of catalyst particles suspended in regeneration gas downwardly therethrough to a catalyst withdrawal funnel 40 in a segment of the vessel adjacent to the catalyst inlet segment. In the regeneration zone 42 housing a mass of the circulating suspended catalyst particles 44 in upflowing oxygen containing regeneration gas introduced to the lower portion thereof by conduit distributor means 46, the density of the mass of suspended catalyst particles may be varied by the volume of regeneration gas used in any given segment or segments of the distributor grid. Generally speaking, the circulating suspended mass of catalyst particles 44 undergoing regeneration with oxygen containing gas to remove carbonaceous deposits by burning will be retained as a suspended mass of swirling catalyst particles varying in density in the direction of catalyst flow and a much less dense phase of suspended catalyst particles 48 will exist thereabove to an upper portion of the regeneration zone. Under carefully selected relatively low regeneration gas velocity conditions, a rather distinct line of demarcation may be made to exist between a dense fluid bed of suspended catalyst particles and a more dispersed suspended phase (dilute phase) of catalyst thereabove. However, as the regeneration gas velocity conditions are increased there is less of a demarcation line and the suspended catalyst passes through regions of catalyst particle density generally less than about 30 lbs. per cu. ft. A lower catalyst bed density of at least 20 lb/cu. ft. is preferred.

A segmented regeneration gas distributor grid 50 positioned in the lower cross-sectional area of the regeneration vessel 42 is provided as shown in FIG. 1 and is adapted to control the flow of regeneration gas passed to any given vertical segment of the catalyst bed thereabove. In this arrangement, it has been found that even with the generally horizontally circulating mass of catalyst, the flow of regeneration gas is generally vertically upwardly through the mass of catalyst particles so that regeneration gas introduced to the catalyst bed by any given grid segement or portion thereof may be controlled by grid openings made available and the air flow rate thereto. Thus, oxygen containing combustion gases after contact with catalyst in the regeneration zone are separated from entrained catalyst particles by the cyclonic means provided and vertically spaced thereabove. The cyclone combinations diagrammatically represented in FIG. 1 are intended to correspond to that represented in FIG. 2. Catalyst particles separated from the flue gases passing through the cyclones are returned to the mass of catalyst therebelow by the plurality of provided catalyst diplegs.

As mentioned above, regenerated catalyst withdrawn by funnel 40 is conveyed by standpipe 6 to the hydrocarbon conversion riser 4.

The regenerator system shown in FIGS. 1 and 2 is usually designed for producing a flue gas that contains a substantial concentration of carbon monoxide along with carbon dioxide. In fact, a typical $CO_2/CO$ ratio is about 1.2.

It will be clear from FIG. 1 that the term "circulating inventory of catalyst" referred to herein includes the catalyst in riser 4, in the dense bed 22, in the dense bed in stripper 24, and in the dense bed in the regenerator 44 s well as the catalyst material in lines 36 and 6 and the catalyst material suspended in the dilute phase and cyclones in the reactor section and the regenerator section. This circulating inventory is everywhere very hot, substantially above about 600° F., since the regenerator operates at a temperature higher than about 1000° F. and the reactor at higher than 800° F.

In actual operation, because the catalytic activity of the circulating inventory of catalyst tends to decrease with age, fresh makeup catalyst usually amounting to about one to two percent of the circulating inventory is added per day to maintain optimal catalyst activity, with daily withdrawal plus losses of about like amount of aged circulating inventory. This catalyst makeup is usually added via a hopper and conduit (not shown) into the regenerator.

The oils fed to this process are principally the petroleum distillates commonly known as gas oils, which boil in the temperature range of about 650° F. to 1000° F., supplemented at times by coker gas oil, vacuum tower overhead, etc. These oils generally are substantially free of metal contaminants.

The chargestock, which term herein is used to refer to the total fresh feed made up of one or more oils, is cracked in the reactor section in a reaction zone maintained at a temperature of about 800° F. to 1200° F., a pressure of about 1 to 5 atmospheres, and with a usual residence time for the oil of from about one to ten seconds with a modern short contact time riser design. The catalyst residence time is from about one to fifteen seconds.

Because the chargestock contains trace amounts of metal, principally nickel and vanadium, tne circulating inventory of catalyst accumulates these metals until a balance is struck between the metals removed from the inventory by catalyst withdrawal and losses, and the amount introduced with fresh feed. It is common to refer to circulating inventory of catalyst which has been in use for some time and has acquired a normal complement of nickel and vanadium as "equilibrium catalyst". Equilibrium catalyst usually is characterized by metals content in the range of about 200 to about 600 ppm Nickel Equivalents of metal, which is defined as $$\text{ppm Nickel Equivalent} = \text{ppm nickel} + 0.25 \text{ ppm vanadium}$$

It has recently been discovered that the inclusion of a minute amount of a metal of period 6 and 7 of Group VIII or rhenium in the composition of the cracking catalyst is very effective for controlling the combustion of carbon monoxide in the regenerator. This is a highly desirable result because the combustion of carbon monoxide not only permits one to reduce the amount of undesirable CO emissions to the atmosphere, but also provides additional heat directly useful in the cracking operation. The described combustion-promoter metals are effective in amounts which do not adversely affect the selectivity of the cracking process, and have been observed to actually increase gasoline yield. This development is more fully described in co-pending U.S. patent application Ser. No. 642,884 filed Dec. 22, 1975

(now abandoned), the entire contents of which are incorporated herein by reference. Additionally, it has been found that these metal compounds need not be deposited on the catalyst during catalyst manufacture, but they may be effectively introduced into the circulating inventory of cracking catalyst during operation of the process. This development is more fully described in U.S. patent application Ser. No. 659,308 filed Feb. 19, 1976 (now U.S. Pat. 4,088,568), the entire contents of which are incorporated herein by reference.

Various references which have been uncovered may bear upon the subject matter of this application. The following list is not suggested to be exhaustive or all inclusive. It does, however, identify those presently known references which, in the opinion of counsel, seem to bear upon this subject matter:

| | |
|---|---|
| U.S. Pat. No. 3,660,310 | Kluksdahl |
| U.S. Pat. No. 3,788,977 | Dolbear |
| U.S. Pat. No. 3,364,136 | Chen et al. |
| U.S. Pat. No. 2,436,927 | Kassel |
| U.S. Pat. No. 3,226,339 | Frilette et al. |

BRIEF DESCRIPTION OF THE DRAWING

FIGS. 1 and 2 exemplify one conventional catalyst section of a fluid catalytic cracking apparatus.

SUMMARY OF THE INVENTION

Figure 3:
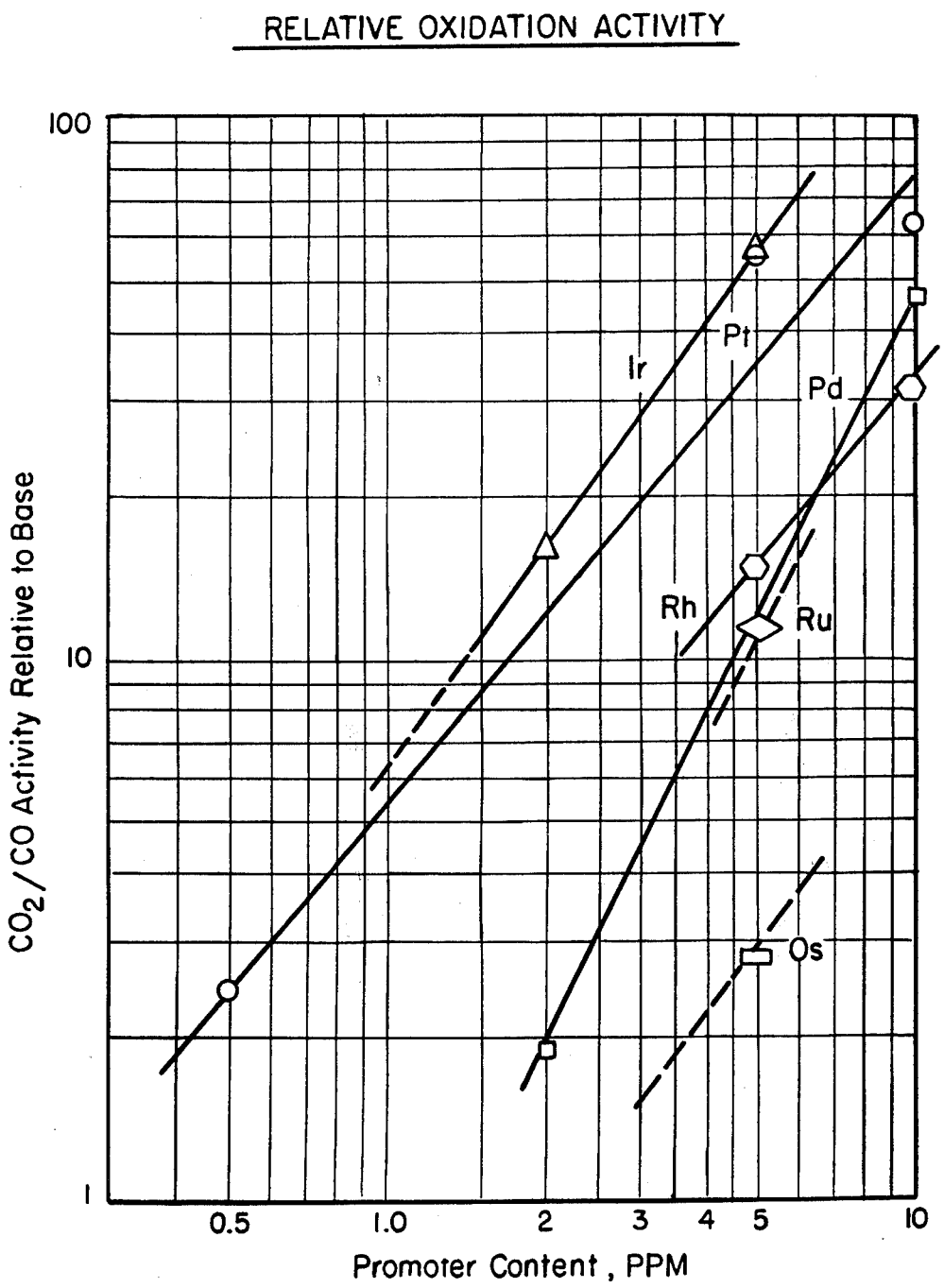
FIG. 3 shows the relative oxidation activity of combustion-promoter-metals.

An improvement has now been discovered in the method of adding a combustion-promoter-metal of the type hereinabove described to the circulating inventory of cracking catalyst in order to increase the combustion of carbon monoxide in the regenerator of a fluid catalytic cracking plant. The improved method comprises taking a side-stream of said circulating inventory of cracking catalyst and contacting it during normal operation of the cracking plant in a contacting zone maintained at a temperature less than about 600° F. with said combustion-promoter-metal or a precursor thereof. After contacting, which serves to add combustion-promoter-metal to the catalyst in the contacting zone, the treated catalyst is returned to the circulating inventory. The actual method of contacting and the contacting conditions themselves may vary widely. For example, contacting may be continuous or discontinuous. In all cases, however, the method and conditions are so chosen as to introduce an amount of combustion-promoter-metal into the circulating inventory effective to control the combustion of carbon monoxide in the regenerator, i.e. to maintain the $CO_2/CO$ in the flue gas at a predetermined level or within a predetermined range. The predetermined level may be anywhere from a $CO_2/CO$ ratio greater than about 2 to about infinity, representing complete combustion.

Contemplated as within the scope of this invention is contacting the side stream of cracking catalyst with the combustion-promoter-metal itself in the form of vapor or aerosol, utilizing, e.g. vacuum deposition or sputtering techniques. Alternatively, a precursor of the metal may be used. These include the vapors of a volatile compound of the metal, or a solution of a metal compound in a solvent. The term solution, as used herein, contemplates a colloidal solution of the metal itself, and a dispersion of a difficultly soluble compound of the metal in a solvent, as well as an ordinary solution of a compound of the metal in a solvent therefor.

In its preferred form, the improved method of this invention comprises taking a side-stream of the circulating inventory of cracking catalyst and impregnating it in a contacting zone with a solution of a compound of said combustion-promoter-metal dissolved in a solvent boiling above about 140° F. but below 600° F., which contacting affects deposition of the metal compound on the catalyst. Before or during contacting, the side-stream is cooled to a temperature less than about 600° F. Thereafter, the side-stream is returned to the circulating inventory of catalyst. The side-stream may originate in different parts of the catalyst section. However, it is preferred that it be taken from the reactor section or coked catalyst conduit to provide a side-stream of coked catalyst. It is also preferred that at least some of the contacting be effected at about or above the boiling point of the solvent, as described hereinbelow.

In order to provide intimate contacting with consequent deposition of or impregnating by metal combustion promoter compound, it is preferred that the catalyst be fluidized in the contacting zone during the contacting period. Useful solvents include water and liquid organic compounds with the described boiling specifications.

It has been discovered that with the method of this invention the effectiveness of the combustion-promoter-metal for promoting combustion of carbon monoxide is enhanced and the possible loss of a portion of the promoter metal or deposition of some of that metal elsewhere than on the catalyst is avoided. The description which follows applies, for the most part, to the hereinabove referred to preferred embodiment, which utilizes a solution of the metal compound, but it is to be understood that the invention is not limited thereto.

DETAILED DESCRIPTION OF THE INVENTION

The metal combustion promoters useful in the present invention are selected from the group consisting of Platinum, Palladium, Rhodium, Ruthenium, Iridium, Osmium, and Rhenium, hereinafter indicated by Pt, Pd, Rh, Ru, Ir, Os, and Re. Although the effectiveness of a particular metal may depend on the particular way in which it is introduced into the catalyst, an indication is given in FIG. 3 of the relative effectiveness obtained with a series of cracking catalysts that contain the different metal combustion promoters deposited in the conventional fashion during preparation of these catalysts. For the purposes of this invention, it is preferred to use platinum.

The metal compounds useful in the present invention include the metal halides, preferably chlorides, nitrates, ammine halides, oxides, sulfates, phosphates and other water-soluble inorganic salts; also, the metal carboxylates of from 1 to 5 carbon atoms; or, the alcoholates. Specific examples include palladium chloride, chloroplatinic acid, tetrammine platinum(II) dichloride, ruthenium penta-ammine chloride, osmium chloride perrhenic acid, dioxobis(ethylenediamine)rhenium(V) chloride, rhodium chloride and the like. Metal organic compounds or organometallic compounds of the described metals also may be used, including metal diketonates, carbonyls, metallocenes, olefin complexes of 2 to 20 carbons, acetylene complexes, alkyl or aryl phosphine complexes and carboxylates of 1 to 20 carbons. Specific examples of these are platinum acetylacetonate, tris (acetylacetonato) rhodium (III), triiodoiridium (III) tricarbonyl, $\pi$-cyclopentadienylrhenium (I) tricarbonyl, ruthenocene, $\pi$-cyclopentadienylosmium (I) dicarbonyl dimer, dichloro (ethylene) palladium (II) dimer, ($\pi$-cyclopentadienyl) (ethylene) rhodium (I), diphenylacetylenebis (triphenylphosphino) platinum (O), bromomethylbis (triethylphosphino) palladium (II), tetrakis (triphenylphosphino) palladium (O), chlorocarbonylbis(triphenylphosphino) iridum (I), palladium acetate, and palladium naphthentate.

It is a feature of this invention that relatively simple and inexpensive metal compounds may be used, such as chloroplatinic acid or tetraammine platinum dichloride.

The solvents useful in the process of this invention include water, polar organic solvents and liquid hydrocarbons, and in general, any organic or inorganic fluids which are solvents for the chosen metal compound. Representative examples of organic solvents include alcohols such as methanol, ethanol, isopropanol, tert-butanol, 2-ethyl hexanol, octanol, glycerol, and ethylene glycol; esters such as ethyl acetate, butyl acetate, amyl acetate; ethers such as diethylene glycol, diisopropyl ether, di-n-butyl ether, cellosolve, methyl cellosolve, butyl cellosolve; hydrocarbons such as octane, nonane, decane, dodecane, hexadecane, benzene, toluene, xylene, cumene; and mixtures thereof.

Mixtures of solvents may be used to advantage as will be hereinafter described in more detail. Such mixtures include, for example, water and ethylene glycol, benzene and cumene, and tertiary butyl alcohol and water. Such mixtures are recited only by way of illustration and are not to be construed as limiting.

The preferred solvents or mixtures thereof useful in the present invention are those that boil above about 140° F. but below 600° F. at contact zone pressure.

It is believed essential for the purpose of this invention to cool the side-stream of hot circulating inventory of cracking catalyst which is at a temperature substantially higher than 600° F., and to cool it prior to contacting to a temperature less than about 600° F. While not wishing to be bound by theoretical considerations, it is believed that the method of this invention is effective, at least in part, because it avoids premature decomposition or agglomeration of the combustion-promoter-metal or precursor thereof, e.g., decomposition of the compound before it has had adequate opportunity to contact the catalyst and achieve optimal distribution on the surface thereof. Therefore, when employing solutions, e.g., it will be understood that the precise temperature for contacting the solution of combustion-promoter-metal and the side-stream of cracking catalyst in order to achieve maximum effectiveness of the promoter metal may vary, depending on the thermal stability of the metal compound itself and the choice of solvent, and in some cases perhaps the nature of the cracking catalyst itself. Unusual effectiveness has been observed, for example, as illustrated hereinbelow, with tetraamine platinum dichloride using water as a solvent at about or above 275° F., which is about the boiling point of water under contact zone pressure of about 30 p.s.i. gage. In general, it is preferred to conduct the contacting step under conditions such that at least a portion of the solvent wets the catalyst.

Prior to the contacting step, the side-stream of cracking catalyst may be indirectly cooled by a cooler employing air or other heat transfer fluid to remove heat across a mechanical barrier such as the wall of a pipe. It also may be directly cooled by contact with an inert gas or water injected into the stream. Combinations of direct and indirect cooling may be used.

It will be recognized by those skilled in the art that at least some direct cooling will perforce occur on contacting the side-stream of cracking catalyst with the solution of compound of combustion-promoter-metal, this cooling resulting from evaporation of solvent. Thus, a substantial portion if not all of the desired cooling may be achieved by simply diluting the solution of metal-promoter-compound with a substantial excess of solvent and injecting proportionally larger aliquots of solution into the contact zone.

Mixtures of solvents of different volatilities may be advantageously used, such as a minor amount of glycerol with a major fraction of water. In such instance, the water acts as co-solvent and a cooler, while the less volatile glycerol provides assurance that the metal-promoter-compound will maintain its integrity, undecomposed, until adequate contact with the catalyst has been achieved. The cooling effectiveness due to solvent volatilization may be enhanced by utilizing a solvent that endothermally decomposes in contact with hot cracking catalyst. Examples are alcohols such as tertiary butyl alcohol which dehydrates to isobutylene and water, or isopropyl alcohol which forms propylene and water. Such endothermally decomposing solvents may be used alone or in admixture with other solvents.

Mixtures of solvents that boil above about 140° F. but below 600° F. are suitable. Mixtures, in general, will be characterized by a boiling range, and it is to be understood that when the expression "boiling range" is used herein it is intended to include both the range of temperatures applicable to mixtures, when such are used, and the single temperature boiling point applicable to a single solvent, when such is used, in which at least 95% of the solvent, i.e., substantially all of the solvent, distills. Furthermore, when reference is made herein to boiling or boiling range without reference to the prevailing pressure, it is to be understood that the prevailing pressure in the contact zone is to be applied, this pressure being most usually from about 10 p.s.i. gage to 50 p.s.i. gage.

Although the side-stream of catalyst may be withdrawn from any part of the hot circulating inventory of cracking catalyst, it appears to be advantageous to utilize a side-stream of coked catalyst for the purpose of this invention. Therefore, it is preferred to withdraw the side-stream from the reactor or from the coked catalyst conduit. When from the reactor, it is preferred to withdraw catalyst from the stripper zone to avoid possible difficulties due to the presence of volatile hydrocarbons on the catalyst, i.e., the coked catalyst should be substantially free of gas oil or conversion products thereof when contacted with the solution of combustion-promoter-metal.

The withdrawn side-stream is conducted to a contact zone where it is contacted with the solution. The solution may be introduced by a spray nozzle or other suitable means promoting intimate contact. It is desirable to maintain the catalyst in the contact zone in a fluidized state, thereby promoting uniform temperature and good distribution of the metal compound on the catalyst. Volatilization of the solvent promotes fluidization. The side-stream, after impregnation, is conducted back and allowed to mix with the hot circulating inventory of catalyst. On return to high temperatures, the compound is believed to decompose, providing the active form of metal combustion promoter. Because of the extremely minute amounts of metal present, it is not possible to determine precisely the nature of the metal in its active form, i.e., whether it is present as elemental metal, as the sulfide, oxide, or in some other form.

The combustion-promoter-metal provided to the catalyst inventory by the method of this invention may be a component of all catalyst particles or only of some of the catalyst particles. In terms of its concentration in the entire system, it must be present in a large enough proportion to be able to effect the reaction of carbon monoxide with oxygen to carbon dioxide, provided the conditions in the regenerator are otherwise sufficient to support this combustion; e.g., sufficiently high temperature and sufficient air. Yet it must not be present in a proportion so large that it substantially adversely affects the operation of the cracking side of the process. This latter, upper limit on metal promoter content is to some extent a reflection of the design capacity of the cracking system including auxiliaries and downstream product resolution facilities compared to actual operating throughput. The upper level of platinum group metal content must be less than that which would cause this design capacity to be exceeded.

Further, as a practical consideration each of the seven metals of the platinum group as defined herein has a different degree of effectiveness for their intended use in this system. Therefore, numerical upper and lower limits of metal proportions are blanketing numbers for the entire group. They are not necessarily applicable as a proper range for any given species within this genus. Thus, for example, an appropriate upper limit for the proportion of metal of the entire platinum group metal genus is about 100 parts per million based upon the finished catalyst formulation. While it is clear that this is a proper upper limit for the genus, it is also clear that this numerical value may be quite high for certain species of the genus, notably platinum and irridium, for which a preferred upper limit of about 10 parts per million is set.

Figure 4:
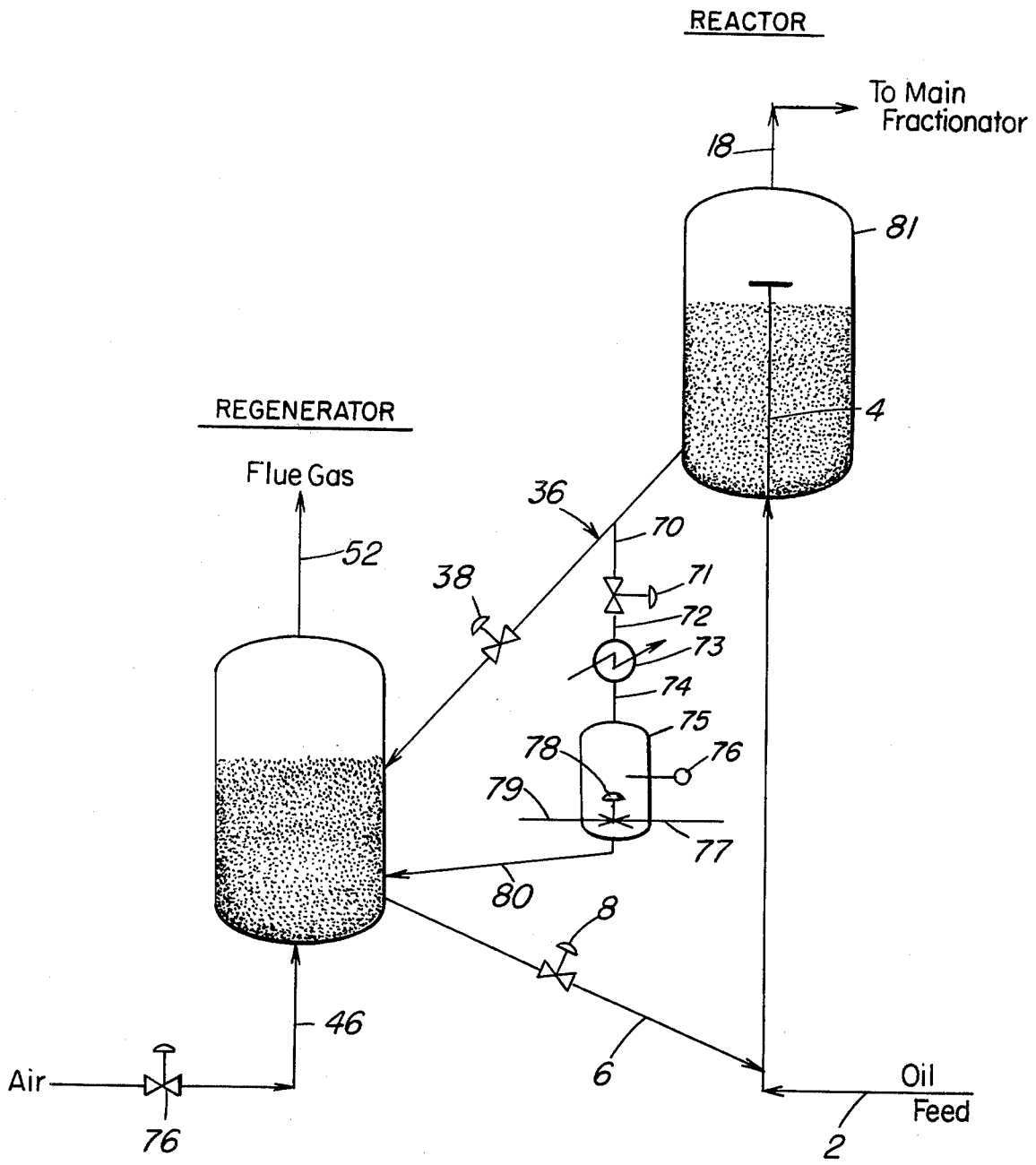
FIG. 4 illustrates a system incorporating one type of side-stream.
Figure 5:
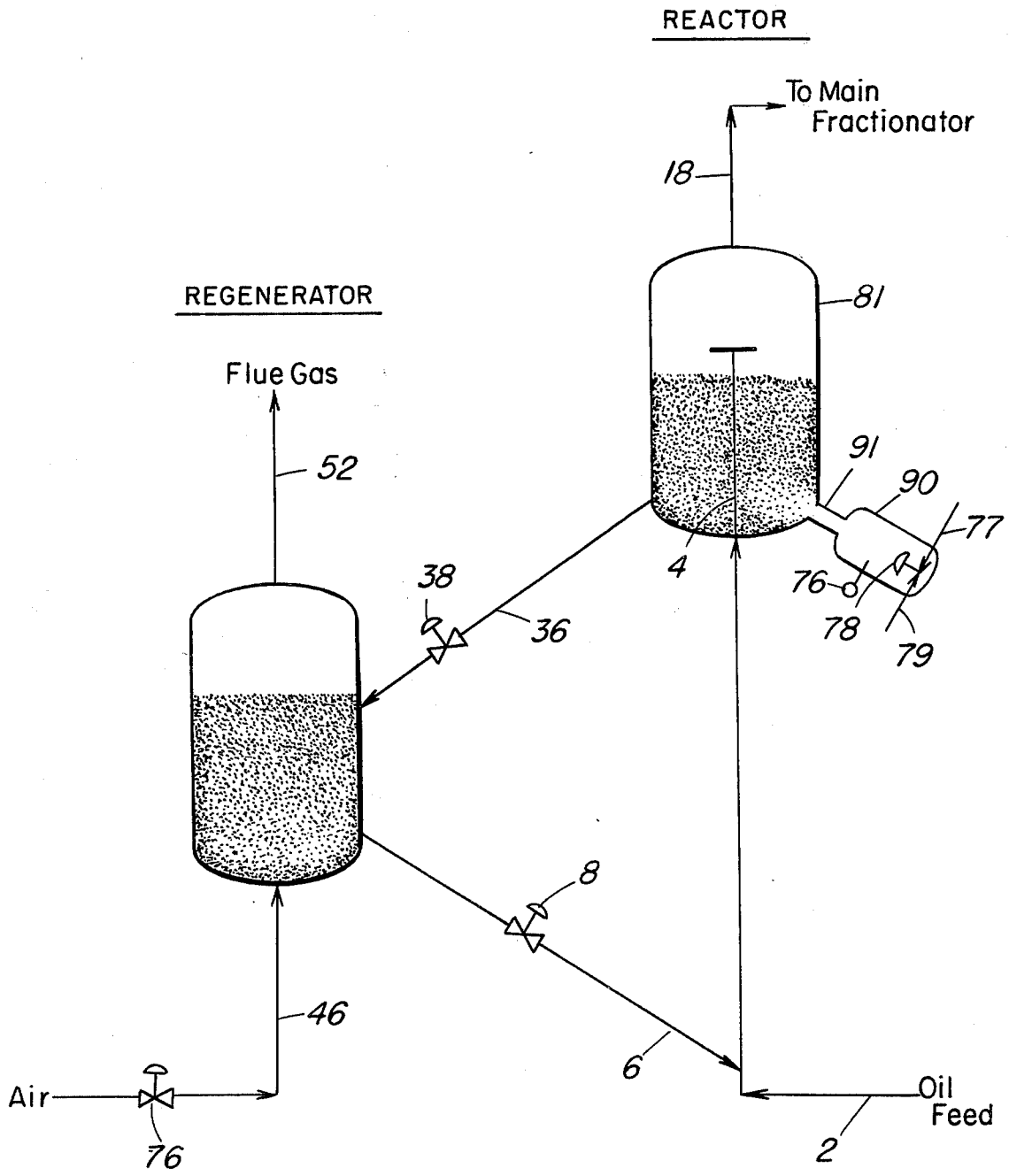
FIG. 5 illustrates a system incorporating a second type of side-stream.

FIGS. 4 and 5 show two arrangements of side-stream and contact zones which exemplify the system of this invention. In both figures the catalyst section shown in FIG. 1 is represented by a simple line drawing; the indicia not otherwise identified in the following paragraphs are repeated from FIG. 1 and identify the same elements as in that figure.

In the side-stream and contacting arrangements shown in FIG. 4, coked catalyst passes from coked catalyst conduit 36 into conduit 70 fitted with control valve 71. The control valve functions to regulate the rate of flow of the side-stream. Material passing the valve is conducted via conduit 72 through heat exchanger 73 which serves to cool the side-stream. The cooled catalyst passes via conduit 74 into vessel 75. Vessel 75 is fitted with a nozzle, sprayhead, or other discharge means 78, which serves to discharge the solution of compound of combustion-promoter-metal fed to the discharge means via conduit 77. Conduit 79 passes into the vessel 75 and also connects with the discharge means 78. This conduit, which may be separate from conduit 77 or combined with it, serves to pass compressed air, steam, nitrogen, volatile solvent, or other inert dispersing medium into vessel 75 for the purpose of maintaining the catalyst in a fluidized state in the contact zone 75. The contacted cooled catalyst is passed via conduit 80 to the regenerator, thus being returned to the circulating inventory.

Although the illustration of FIG. 4 shows the side-stream being taken from conduit 36, which originates in the stripping zone 24 shown in FIG. 1, it may equally well be taken from the reactor vessel 81 directly or from the regenerator, or from regenerated catalyst conduit 6, or at any convenient point in the hot circulating inventory of catalyst. Although the side-stream in FIG. 4 is shown returned to the circulating inventory via conduit 80, which returns the stream to the regenerator, it might equally well be returned to any convenient portion of the catalyst section such as to regenerated catalyst conduit 6, for example.

It is to be noted that vessel 75 is conveniently provided with temperature measuring means such as thermcouple means 76. FIG. 5 illustrates another arrangement of the system of this invention. In this arrangement, a vessel 90 communicating with conduit 91 is attached to the stripping zone of the reactor vessel 81, with free communication of the contents of the stripping zone and vessel 90 via conduit 91. Conduits 77 and 79 and discharge means 78 refer to the same elements as shown in FIG. 4. Conduits 77 and 79 pass into vessel 90, and discharge means 78 is located within said vessel. In this system, fluidized catalyst passes from the stripper zone 24 into vessel 90, is contacted with the solution of metal combustion promoter compound and is returned via the same conduit to the stripper zone. It is evident that the attachment of 91 may be made elsewhere than as shown, such as to the regenerator. It is preferred, however, that the attachment be to such points as will provide communication of the contents of vessel 90 and a fluidized bed of hot coked catalyst.

Whereas this invention has been illustrated by reference to a swirl regenerator as shown in FIG. 1, for example, it is equally applicable to system in which other designs of regenerator are used, such as a riser regenerator designed for the complete combustion of carbon monoxide. By the method of this invention, a solution of a compound of a combustion-promoter-metal may be applied to virgin catalyst or to equilibrium catalyst. Furthermore, it may be used as the only method for providing said combustion-promoter-metal to said catalyst, or it may be used in conjunction with makeup catalyst that contains metal-combustion-promoter deposited thereon during its preparation. The method of this invention may be used to control the combustion of carbon monoxide in the regenerator, said control being achieved by suitable coupling means which control the flow rate of the side-stream or the pumping rate or the concentration of the solution of a compound of combustion promoter metal, in response to the composition of the flue gas, for example.

The following examples illustrate certain aspects of this invention and are not to be construed as limiting thereon. All parts or percentages given are by weight unless otherwise specified.

EXAMPLE 1

In this example and those which follow, a continuous FCC pilot plant was used. The pilot plant consisted of a regenerator, a riser reactor corresponding to 4 of FIG. 1, communicating with a stripping zone corresponding to 24 of FIG. 1 and conduits corresponding to 6 and 36 of FIG. 1. Equilibrium catalyst was withdrawn from a commercial catalytic cracking plant and used in this and subsequent examples described herein. The catalyst was a typical commercial material of the rare-earth exchanged faujasite type, with the faujasite dispersed in a silica alumina matrix. Its composition was found to be 61.3% $SiO_2$, 35.9% $Al_2O_3$, 2.77% $Re_2O_3$, 0.51% Na, 359 ppm Nickel and 404 ppm Vanadium.

For the purpose of this example, a vessel in the form of a tube, as illustrated in FIG. 5, was provided attached to and communicating with the dense bed in the regenerator. The tube had a volume of 25 cubic centimeters.

The vessel was provided with a nitrogen supply to maintain the catalyst as a fluid in the tube.

Prior to starting the contacting and impregnation of the catalyst with the combustion-promoter-metal compound, the pilot plant unit was started up with an inventory of 3500 grams of the hereinabove described catalyst and with wide-cut gas oil from a Mid-Continent crude as feed, and the operating conditions adjusted about as follows:

| | |
|---|---|
| Reactor temperature, °F. | 1000 |
| Stripper temperature, °F. | 1000 |
| Regenerator temperature, °F. | 1250 |
| Catalyst residence time in riser, seconds | 7.0 |
| Oil residence time in riser, seconds | 4.5 |
| Cat to Oil wt. ratio | 6.0 |

A solution of 6 milligrams of metallic platinum as tetraammine platinum dichloride in 250 ml of water was charged to a supply burette. The solution was pumped as a jet into above-described tube containing fluidized catalyst, the pumping rate being adjusted to give a contact zone temperature of about 350° F., as indicated by a skin-temperature measurement. Prior to introduction of the solution, the contact zone temperature measured about 900° F. The adjusted pumping rate was 66 ml/hr, and was terminated after 231 ml of solution had been pumped into the contact zone. Samples of catalyst were withdrawn from the stripper at half-hour intervals and evaluated for catalytic effectiveness in combustion of carbon monoxide.

The results are summarized in Table 1.

Table 1

| Sample No. | Impregnation Time | | ppm Pt | $CO_2/CO$ Ratio |
|---|---|---|---|---|
| 1 | 0 | minutes | 0 | 2.7 |
| 2 | 30 | " | 0.22 | 4.7 |
| 3 | 60 | " | 0.44 | 3.7 |
| 4 | 90 | " | 0.66 | 3.9 |
| 5 | 120 | " | 0.88 | 3.6 |
| 6 | 150 | " | 1.10 | 4.7 |

EXAMPLE 2

The procedure of Example 1 was repeated with a fresh charge of equilibrium catalyst, except that heavy vacuum gas oil derived from a Sour West Texas Crude was used instead of the wide-cut gas oil. In this experiment, 6 milligrams of platinum as tetraammine platinum dichloride was dissolved in 180 ml of water. The solution was pumped at the rate of 119 ml per hour for one hour, at which time the temperature in contact zone was about room temperature. A catalyst sample withdrawn from the stripper at one hour showed no increased activity for promoting CO combustion. The impregnation was continued for a second hour, pumping 78 ml of the described solution, at the end of which period the temperature of the contact zone was about 350° F. A sample of catalyst, withdrawn after the two hours of impregnation, gave a $CO_2/CO$ ratio of 6.3 compared with a ratio of 2.7 for the catalyst before impregnation. The calculated promoter metal content of the sample was 1.9 ppm.

EXAMPLE 3

For the purpose of this example, the tubular vessel used for contacting was attached to the stripping zone of the pilot plant. The system was charged with untreated equilibrium catalyst and adjusted as described in Example 1 but using the heavy vacuum gas oil used in Example 2.

A solution of 2 milligrams of platinum in 250 ml of water was pumped at a rate of 90 ml/hr to contact the catalyst until 135 ml of solution was consumed. The temperature in the contact zone varied from about 400° F. initially, dropping to 220° F. at which point the run was terminated and a sample of catalyst taken. The sample was calculated to contain 0.31 ppm platinum, and gave a $CO_2/CO$ ratio of 410.

EXAMPLE 4

Example 3 was repeated with a fresh charge of equilibrium catalyst but the flow rate of the contacting solution and the nitrogen flow rate were adjusted to keep the contact zone temperature in the range of from about 400° F. to about 600° F. A sample of the final catalyst, calculated to contain 0.29 ppm platinum, gave complete combustion of carbon monoxide, i.e., a $CO_2/CO$ ratio of infinity.

What is claimed is:

1. An improved method for adding a minute amount of at least one combustion-promoter-metal selected from the group consisting of Pt, Pd, Rh, Ru, Ir, Os and Re to the circulating inventory of cracking catalyst contained in the catalyst section of a fluid catalytic cracking plant, said catalyst section comprising a reactor with a stripping zone, a regenerator wherein coke is combusted with the formation of CO and $CO_2$, a coked catalyst conduit for passing coked catalyst from said reactor to said regenerator and a regenerated catalyst standpipe for passing regenerated catalyst from said regenerator to said reactor, said circulating inventory of catalyst being at temperatures substantially higher than 600° F., which method comprises flowing a continuous side-stream from said circulating inventory of cracking catalyst through a contact zone and back to said inventory, and contacting said side stream in said contact zone at a temperature of less than about 600° F. with a solution of a compound of said metal dissolved in a solvent boiling above about 140° F. but below 600° F., or with the vapor or an aerosol of said metal, whereby adding to said circulating inventory an amount of combustion-promoter-metal effective to control the combustion of CO in said regenerator without substantially adversely affecting the cracking in said reactor.

2. The improved method claimed in 1 wherein said continuous side-stream consists of coked catalyst.

3. The improved method claimed in claim 1 wherein said continuous side-stream flows from said stripping zone of said reactor.

4. The improved method claimed in claim 1 wherein said continuous side-stream flows from said coked catalyst conduit.

5. The improved method claimed in claim 1 including the step of fluidizing said side-stream in said contact zone prior to and during said contacting step.

6. The improved method claimed in claim 1 wherein said contact zone is a separate chamber in which the side stream is fluidized and contacted with said solution of a compound.

7. The improved method claimed in claim 1 wherein said combustion-promoter-metal comprises platinum and said solvent is water.

8. The improved method claimed in claim 1 wherein said contacting of said side-stream in said contact zone is with an amount of solution sufficient to cool the side-stream to about the boiling range of the solvent at contact zone pressure.

9. The improved method claimed in claim 1 wherein said solvent comprises an organic compound endothermally decomposable on contact with hot cracking catalyst.

10. The improved method claimed in claim 1 wherein said circulating inventory of cracking catalyst is equilibrium catalyst that contains about 200 to about 600 ppm nickel equivalents of metal and said combustion-promoter-metal comprises platinum.

* * * * *